United States Patent [19]

Guero et al.

[11] Patent Number: 4,593,260

[45] Date of Patent: Jun. 3, 1986

[54] CONTACT WITH A MAGNETIC COMPENSATOR

[75] Inventors: Jean P. Guero, Bezons; Guy H. Lacan, Maisons Laffitte, both of France

[73] Assignee: La Telemecanique Electrique, France

[21] Appl. No.: 697,199

[22] Filed: Feb. 1, 1985

[30] Foreign Application Priority Data

Feb. 3, 1984 [FR] France ..... 84 01665

[51] Int. Cl.[4] ..... H01H 3/00; H01H 75/00; H01H 53/00

[52] U.S. Cl. ..... 335/195; 335/16; 335/147

[58] Field of Search ..... 335/16, 195, 147

[56] References Cited

U.S. PATENT DOCUMENTS 4,472,698 9/1984 Siffroi et al. ..... 335/195
4,513,270 4/1985 Belbel et al. ..... 335/195

*Primary Examiner*—E. A. Goldberg
*Assistant Examiner*—Lincoln Donovan
*Attorney, Agent, or Firm*—William A. Drucker

[57] ABSTRACT

A contact that has two fixed contact elements and a mobile contact bridge actuated by a switching assembly and is urged by a pole spring. The connection between the mobile contact bridge and switching assembly is provided by a magnetic compensator connected to the switching assembly by means of a magnetic coupling device adapted so that, when the compensating forces rise above a given threshold, the magnetic compensator is disengaged from the switching assembly and becomes inoperative.

15 Claims, 10 Drawing Figures

PRIOR ART

CONTACT WITH A MAGNETIC COMPENSATOR

BACKGROUND OF THE INVENTION

1. Field of the Invention

The present invention relates to a device for cleanly opening the mobile contacts of an on-load current breaking apparatus such for example as a contact maker-breaker comprising at least two fixed contacts and a mobile contact bridge having at least two mobile contacts which are applied against the fixed contacts under the effect of a pole spring in the closed position of the contactor.

2. Description of the Prior Art

It is generally known that, when contact circuits have abnormally high currents flowing therethrough, for example due to a short circuit, the contacts are subjected to repelling forces by electrodynamic effect. This phenomenon occurs in particular in contact circuits comprising fixed contact-carrying conductors bent in the form of a J because of the passage of currents in opposite directions in one of the two legs of the J and in the mobile contact bridge.

Thus, as soon as the current reaches an excess current threshold, these repelling forces overcome the action of the pole spring and cause opening of the contact, which results in breaking the current. With this breaking of the current, the repelling forces disappear so that the mobile contacts pushed by the spring fall back onto the fixed contacts and thus close the circuit again.

In the case of high over currents, since this repulsion is very sharp, the mobile contacts are moved well away from the fixed contacts and the risks of closing again under load are small.

On the other hand, for smaller over currents, the repelling forces occur close to the current peak and, since they are much smaller, when they cease the contacts close again on a current which is still high, so that there is an appreciable risk of welding which is added to the other risks of destruction of the apparatus and the inevitable wear of the contacts.

To overcome these disadvantages, it has been proposed to compensate for the effect of these repelling forces during the time interval separating the application of the over current and opening of the circuit, so as to prevent the fixed and mobile contacts from being separated in an untimely manner, with the consequences which would be caused for certain values of the overcurrent.

This compensation may be achieved, in accordance with the solution proposed in French patent application No. 81 22957 filed in the name of the applicant, by means of a first piece made from a magnetic material having the shape of a U whose base is coupled to the switching assembly of the contactor, and a second magnetic piece integral with the contact carrying mobile bridge, adapted so as to form an air gap with the upper ends of the legs of the U of the first piece, the mobile contact carrying bridge being engaged in the opening of the U of the first piece so as to form a second air gap. With such a device, as long as the intensity of the overload current remains below an overcurrent threshold, the second magnetic piece exerts on the first a force of attraction sufficient to counteract the effect of the repellent forces. Beyond this over current threshold, the force exerted by the compensator reaches a limit value due to the saturation of the magnetic material pieces, whereas the repellent forces between the contacts continue to increase, so that opening of the contact occurs. However, in such a device, there exist operating zones in which the resultant force on the contact bridge varies slowly as a function of the overcurrent values of the current flowing in the current bridge. If this small variation occurs towards cancellation of the contacting force, the opening speed thereof will be low, which will cause risks of cut-off failure of the type described above.

A device is further known, more especially from French patent application No. 81 15606 filed in the name of the applicant, for releasing the mobile contacts of the contactors, so as to limit the shore circuit currents. This device uses more especially a threshold coupling between the mobile contact bridge and the switching assembly which is associated therewith. In this device, the threshold coupling is formed by balls housed directly in a rod integral with the mobile contact bridge and cooperating with a resilient clamp connected to the switching assembly. It is then apparent that, in this device, the pole force causes a permanent stress on the threshold coupling in the working condition even when the current is less than the normal current of use. This stress, combined with the high number of switching operations which the apparatus must make under normal conditions of use, causes fatigue of the coupling which may lead to a considerable drift of the longitudinal holding force and thus considerable dispersion of the overcurrent values causing disengagement of the coupling.

The purpose of the invention is then to overcome all these disadvantages. It provides a contact using a device for compensating the repellent forces of a type similar to the one described in the above French patent application No. 81 22957 but in which, when the electrodynamic repellent force due to an abnormal over current exceeds a predetermined value, opening of the contacts is obtained with a considerably increased speed and is maintained at least temporarily.

SUMMARY OF THE INVENTION

To arrive at this result, the contact circuit of the invention comprises first of all, as previously mentioned, at least two fixed contacts and a mobile contact bridge actuated by a switching assembly and carrying at least two mobile contacts which are applied respectively, under the effect of a pole spring, on the two fixed contacts in the closed position of the contactor. The connection between the mobile contact bridge and the switching assembly is provided by a magnetic compensator generating a compensating force tending to apply the mobile contacts on the fixed contacts under the effect of the current flowing through the mobile contact bridge and this against the action of the repellent forces which are then exerted between these contacts. In accordance with the invention, the connection between the magnetic compensator and the switching assembly is provided by means of a magnetic coupling device adapted so that, when said compensating forces rise above a predetermined threshold, the magnetic compensator is disengaged from the switching assembly and becomes inoperative and so that consequently a very sudden variation of the resultant repellent force exerted on the mobile contact bridge is obtained with very rapid opening of the contactor to the frankly opened condition.

More precisely, said magnetic compensator may comprise at least a first piece made from a soft magnetic material integral with the switching assembly and a second piece made from a soft magnetic material carried by the mobile contact bridge and forming, with said first piece, an air gap e at the level of which are exerted the compensating forces generated by the passage of the current through the mobile contact bridge. In this case, the connection between the first soft magnetic material piece and said switching assembly is provided by a magnetic coupling comprising a magnetic anchorage circuit formed from two parts movable with respect to each other, namely a first part integral with the first soft magnetic material piece and a second part integral with the switching assembly. Preferably, the first part of this magnetic anchorage circuit consists of a plate made from a soft magnetic material, whereas the second part may consist either of a permanent magnet or an electromagnet against which the plate is applied.

It is clear that, with the previously described contact, when the compensating forces become higher than the attraction forces exerted between the two parts of said magnetic oupling, this latter is suddenly disengaged while making the magnetic compensator inoperative, which causes the mobile contact bridge to be completely repelled. The contact is then in the frankly open state and the mobile contacts then only fall back well after breaking of the current. When falling back, the first part of the magnetic coupling is again attracted against the second part and thus automatic resetting of the contact is obtained.

Of course, it is possible to provide a device for delaying with the return of the contacts to the reset position or even a device providing locking, at least temporarily in the tripped position, so that automatic resetting can only occur voluntarily or simply when the short circuit has disappeared. Such a time delay allows in particular the arc foot to move and the breaking zone to cool down before the contact is closed again on a limited current.

It is clear that the above described contact does not have the drawbacks of devices using a threshold coupling between the mobile contact bridge and the switching assembly such as the one described in the above mentioned French patent application. In fact, in this contact, there can be no question of fatigue of the magnetic coupling, so that the overcurrent value causing disengagement of the magnetic compensator will be constant whatever the number of switching operations before the occurrence of the short circuit. Moreover, the disengagement threshold of the magnetic coupling, under the effect of the compensating forces, may be adjusted by adjusting the air gap of the compensator, for example by means of an adjusting screw. Similarly, it is possible to adjust the magnetic flux of the magnetic circuit formed by the magnetic coupling, for example, in the case where this latter comprises an electromagnet, by adjusting for example the intensity of the current supplying the winding of the electromagnet.

As mentioned above, the above described device may serve for forming a contact maker-breaker, in which the switching assembly is connected to the armature of an electromagnet. The supply circuit of this winding may then be controlled by a quick-break contact whose mobile part is mechanically connected to the magnetic compensator so as to assume two states, namely:

a closed state when the magnetic compensator is coupled to the mobile assembly, and an open state when the magnetic compensator is disengaged from the mobile assembly.

BRIEF DESCRIPTION OF THE DRAWINGS

Some embodiments of the invention will be described hereafter, by way of non limitative examples, with reference to the accompanying drawings in which.

DESCRIPTION OF THE PREFERRED EMBODIMENTS

Figure 1:
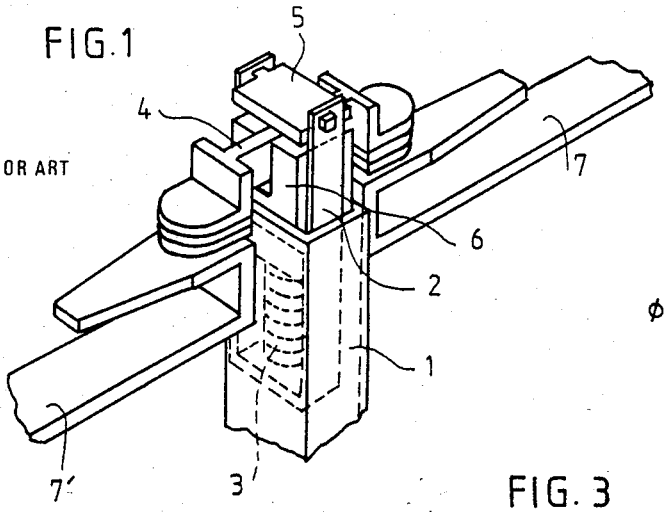
FIG. 1 PRIOR ART
FIG. 1 is a schematical perspective view illustrating the principle of a contact equipped with a system for the magnetic compensation of the repellent forces exerted on the contacts.
Figure 2:
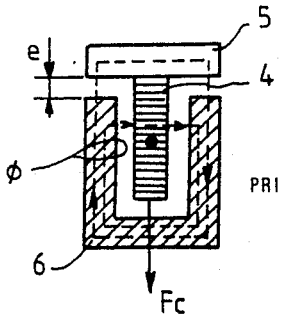
FIG. 2 is a schematical view showing the magnetic circuit of the compensator used in the contact shown in FIG. 1.
Figure 3:
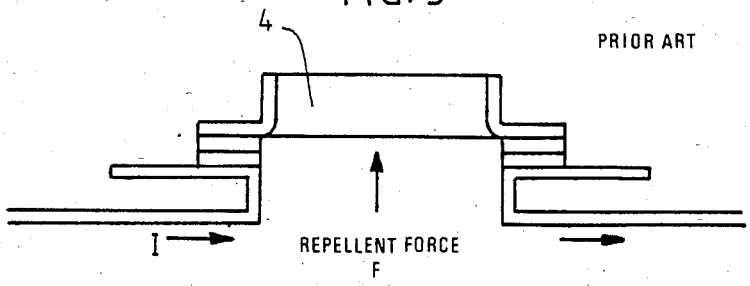
FIG. 3 PRIOR ART
FIG. 3 is a schematical side view of the fixed contacts and of the mobile contact bridge of the contact shown in FIG. 1.

As mentioned above, FIG. 1 shows one example of a contact circuit equipped with a magnetic compensator of the type described in the above mentioned French patent application No. 81 22957. In this compensator, the switching assembly comprises an insulating piece or "rake" 1 which drives an amagnetic coupling stirrup 2 through a pole spring 3 which, in the working condition, determines the contacting force in the absence of any current. The mobile contact bridge 4, in the form of a beam, is connected to the coupling stirrup 2 through a magnetic plate 5 which forms, with a magnetic U 6 surrounding the contact bridge 4, the magnetic circuit of an electromagnet whose operation is illustrated in FIG. 2. The current I flowing through the mobile contact bridge 4 creates in the magnetic circuit formed by plate 5 and the magnetic U 6 a magnetic flux $\phi$ whose part flowing through the air gap e creates the compensating force between plate 5 and the magnetic U 6 and consequently between the mobile contact bridge 4 and the magnetic U 6. The fixed contact supports 7, 7' may have advantageously the form of a J so as to promote the electrodynamic repellent force F (FIG. 3) when a high current such as a short circuit overcurrent flows in the contact circuit.

In this known embodiment, the magnetic U of the compensator is rigidly fixed to the insulating rake 1. Thus, the compensating force, although proportionally decreasing because the air gap e increases when the contact begins to open, continues to exist during opening of the contact by a short circuit repellent force, thus tending to slow the opening down. The variations of the compensating the repellent forces as well as the variation of the resultant force on the mobile contact bridge are shown in the diagram of FIG. 4, in which the curve $K_1$ shows the force exerted by the compensating device, curve $K_2$ shows the resultant force applied to the mobile contacts, the straight line $K_3$ represents the pole force exerted by the pole spring and curve $K_4$ represents the repellent force.

Figure 4:
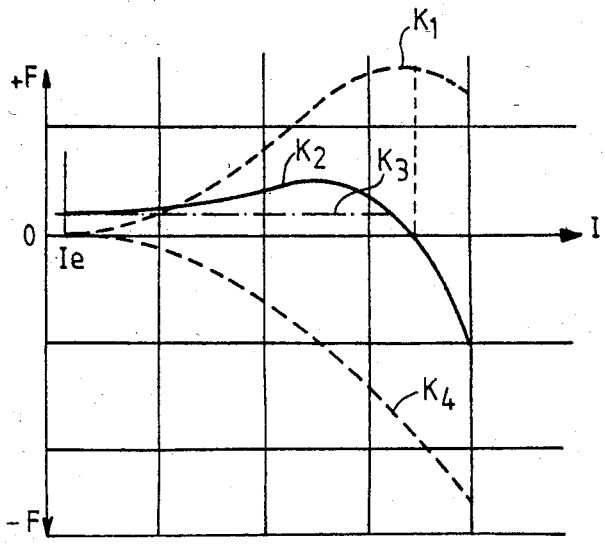
FIG. 4 is a diagram showing, as a function of the intensity of the current, the laws of variation of the forces acting on the mobile contact bridge.

In this FIG. 4, the different forces acting on the contact bridge 4 are shown as a function of the current flowing through the contact. The force of spring 3 (pole force, straight line $K_3$) which is transmitted by the coupling stirrup is constant. The repellent and compensating forces are negligible for the currents of normal use Ie which are always very much less than short circuit over currents. By way of example, these currents in normal use Ie may be less than 50 times smaller than the current I causing opening by repulsion. When the current rises, at the beginning, the compensating force increases more rapidly than the repellent force, then, when the magnetic saturation of the compensator occurs, the compensating force increases more slowly. Thus, the resultant force applied to the contacts which, at the beginning, was increasing, decreases then is reversed causing opening of the contact.

Although, as soon as the contact is open, the compensating force tends to decrease because of the increase of the air gap e of the compensator, the rate of variation of the resultant force when passing to zero may not be sufficiently high to provide a perfect break if the short circuit current is just above the balance point where the resultant force is close to zero.

Figure 5:
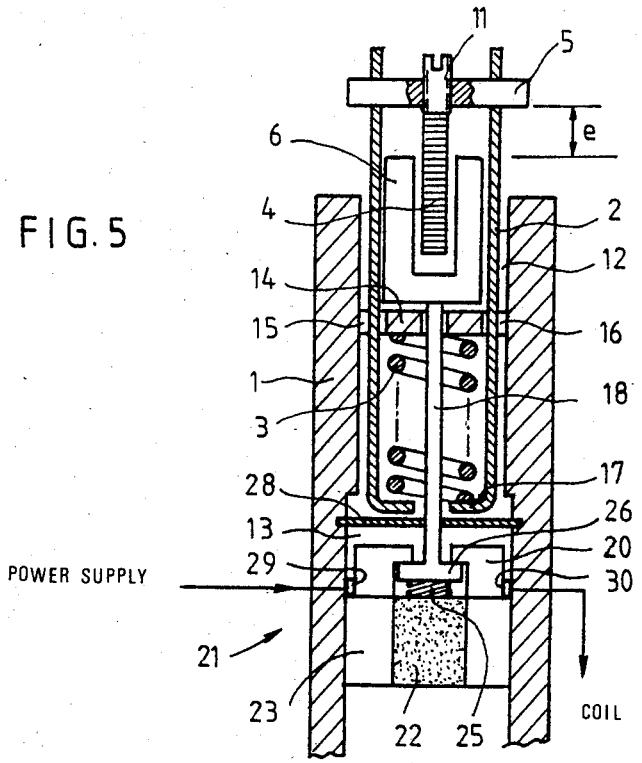
FIG. 5 is a partial schematical sectional view of a contact equipped with a magnetic compensator connected to the switching assembly through a magnetic coupling.

As previously mentioned, FIG. 5 is a sectional view of a magnetic compensator coupled to the switching assembly 1 by the magnetic coupling, in accordance with the present invention. In this Figure, we find again a mobile contact bridge 4 integral with the plate 5 of the compensator, the connection between these two pieces being provided by means of a device allowing their respective positions to be adjusted by means of a screw 11, so as to be able to adjust the width of the air gap e between plate 5 and the magnetic U 6.

However, in this embodiment, the switching assembly 1 comprises two coaxial pockets, 12, 13 separated from each other by a dividing wall 14 having two opposite passages 15, 16 therethrough.

In the upper pocket 12 are mounted, for axial sliding, the magnetic U 6 of the compensator and the coupling stirrup 2, which passes through the two bores 15, 16 and extends inside pocket 13. The pole spring 3 then exerts its action between dividing wall 14 and the bottom 17 of stirrup 2, so that it exerts a force tending to apply the magnetic plate 5 against the magnetic U 6 and the mobile contact bridge 4 against the fixed contacts.

Furthermore, the dividing wall 14 as well as the bottom 17 of the coupling stirrup 2 are provided with two coaxial bores through which passes a rigid and light rod 18 fixed by one of its ends to the web of the magnetic U 6 and supporting, at its other end a plate made from a soft magnetic metal 20 which serves as mobile part for a magnetic circuit with permanent magnet 21, whose fixed part 22 and 23 is fixed to the switching assembly 1.

In the closed state of the contact (such as shown in FIG. 5), plate 20 of the magnetic circuit 21 (which plays the role of load-break locking device)exerts on the magnetic U 6 a holding force which is opposed to the force of the compensator. By adjusting the air gap e with the adjusting screw 11, the force of the compensator is regulated so that, for a given value of the short circuit current, plate 20 is disengaged.

It should be noted in this connection that, because of the small slope of the pole spring 3, adjustment of air gap e has no influence on the force applied to the contacts.

From the beginning of opening of its circuit, the holding force exerted on plate 20 and the fixed part 22, 23 of the magnetic circuit 21 decreases suddenly cancelling out the reaction of the magnetic compensator and allowing complete repulsion of the mobile contact bridge 4.

Figure 6:
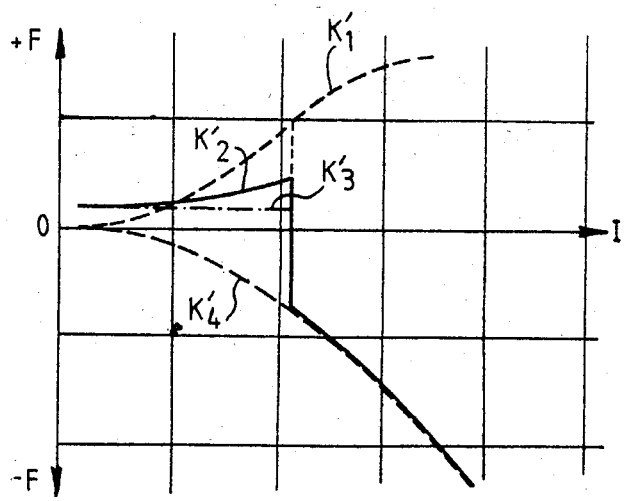
FIG. 6 is a diagram showing the laws of variation of the forces exerted on the mobile contact bridge of a contact of the type shown in FIG. 5.

The diagram shown in FIG. 6 bridges out better the advantages offered by a magnetic compensation contact equipped with a magnetic coupling such as the one shown in FIG. 5. In this diagram, the curves corresponding to those of the diagram of FIG. 4 bear the same references to which a prime index has been added.

Thus, in FIG. 6, we find again the increase of the positive resultant force (curve $K_2'$) on the mobile contact bridge 4 up to a value Ia of the intensity of the short circuit current which corresponds to a compensating force (curve $K_1'$) equal to the disengagement force Fa of the magnetic circuit 21. As soon as it is released, under the effect of the compensating force, part 6 of the compensator is attracted towards part 5 and comes into abutment at the end of travel against the mobile bridge 4 thus cancelling out the compensating force (curve $K_1'$) and communicating a shock to the mobile bridge 5. Thus, the resultant force (curve $K_2'$) becomes suddenly negative and, after the shock phenomenon, becomes equal to the pole force less the repellent force which is much higher than this pole force. In the example shown in FIG. 6, curves $K_4'$ and $K_2'$ are substantially superimposed from the point Ia.

The inertia of the mobile assembly comprising the magnetic U 6, rod 18 and plate 8 may be further offset by means of a separation spring 25 disposed between plate 20 and the fixed part 22, 23 of the magnetic circuit 21. This spring 25 launches the mobile assembly 6, 18, 20 when plate 20 begins to separate from the fixed part 22, 23.

It should be noted that the connection between rod 18 and plate 20 is arranged so as to provide a ball-joint effect between these two pieces and thus obtain stressless positioning of plate 20 on the fixed part 22, 23 of the magnetic circuit 21.

For this, rod 18 ends in a head 26 housed in a cavity in plate 20 and having a substantially spherical bearing surface which cooperates with a spherical surface of said cavity. in this case, spring 25 bears on the head 26 so as to cancel out the play which might exist in the ball-jointed connection 20–26.

The above described contact may further comprise a device for adjusting rod 18 in length so as to compensate for the tolerances in the respective positions of the fixed part 22, 23 of the magnetic anchorage circuit 21 and dividing wall 14.

Figure 7A:
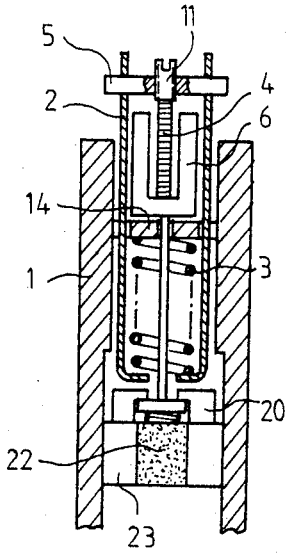
FIGS. 7A to 7C are sectional views for illustrating the operation of a contact shown in FIG. 5.
Figure 7B:
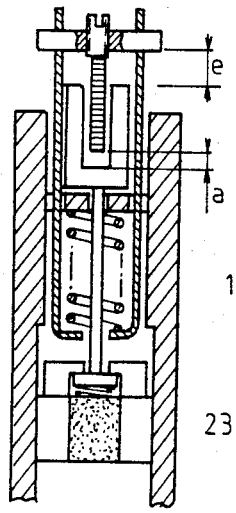
Figure 7C:
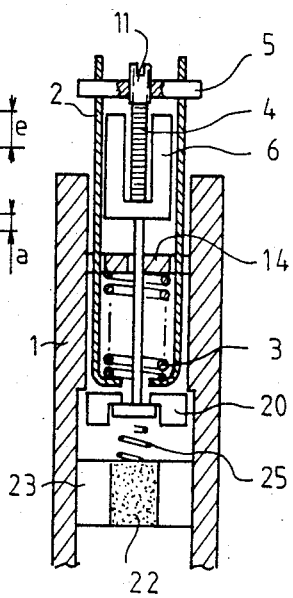

FIGS. 7A to 7C illustrate the operation of the contact shown in FIG. 5.

Thus, in FIG. 7A, the whole of the contact is at rest, with plate 20 applied to the fixed part 22, 23 of the magnetic anchorage circuit 21. The switching assembly 1 is then in the top position and raises the mobile contact bridge 4.

In FIG. 7B, the contact is shown in the working position. The switching assembly 1 is in the low work position, with the contacts of the mobile contact bridge 4 applied to the fixed contacts with a contacting force due to the compression a of the pole spring 3. The air gap between plate 5 and the magnetic U 6 of the compensator is at its working width e.

In FIG. 7C, the switching assembly 1 is still in the low work position. However, in this case, plate 20 of the magnetic anchorage circuit 21 is in the disengaged position and the magnetic U 6 is engaged against the mobile contact bridge 4 which is subjected to the electrodynamic repellent forces under the effect of a short circuit current.

From this position, when the current passing through the mobile bridge 4 and the electrodynamic repellent forces which result therefrom have ceased, the contact will come back to the work position shown in FIG. 7B.

As mentioned above, this return to the work position may be delayed. In the example shown in FIG. 5, this delay is provided by a membrane 28 disposed in the lower part of pocket 13 and through which rod 18 passes. This membrane 28 forms a one way air damper in that it is inoperative in the repellent direction of the contact, but causes slowing down of the return of the contactor to the work (or reset) position, so as to avoid reclosure of the contact before extinction of the breaking arc. This membrane 28 further provides an anti-dust protection so as to keep intact the magnetic bearing surface of plate 20 and of the fixed part 22, 23 of the magnetic anchorage circuit 21.

As mentioned above, the above described device may serve for constructing contact makers-breakers. In this case, the switching assembly may be fixedly mounted on the mobile armature of an electromagnet not shown whose winding is supplied from a supply circuit comprising a quick-break contact.

In the example shown in FIG. 5, this quick-break contact comprises at least two fixed contacts 29, 30 carried by the fixed part 22, 23 of the magnetic anchorage circuit 21, and on which is applied plate 20 which then has the role of mobile contact carrier. Thus, when plate 20 is disengaged from the fixed part 22, 23, supply to the winding of the electromagnet is interlocked and the contact maker-breaker tends to return to the rest position; concurrently, when the short circuit current has ceased, the resetting procedure will take place. If the time for breaking the short circuit is less than the time required for the contactor to return to the rest position (depolarization of the magnetic circuit), resetting occurs while the contactor is still in the closed state, which gives the contact maker-breaker situated downstream time to trip (starting selectivity).

Of course, the invention is not limited to this characteristic. In fact, the contact circuits may also comprise a device for locking the magnetic compensator in the disengaged state. This locking device may consist of a mechanical device, whose unlocking is controlled manually or even of an electromechanical device, for example of the electric keeper type, controllable from a distance.

As was mentioned above, adjustment of the force required for disengaging the magnetic anchorage circuit 21 allows the value of the short circuit current to be accurately defined above which the contact will open by electromagnetic repulsion.

Thus, in an electric installation comprising several contact makers-breakers of the type previously described, it is possible to provide on each of these contact makers- breakers a different adjustment so as to stagger the current values causing disengagement and thus obtain "selectivity" of the protective devices of the installation.

Figure 8:
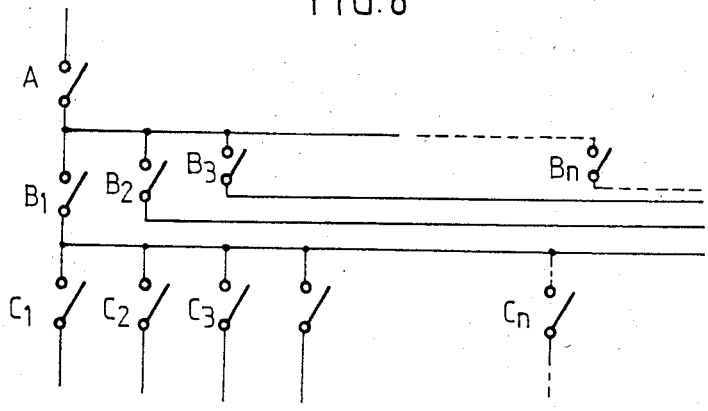
FIG. 8 is a schematical representation of an electric installation using a plurality of contact makersbreakers providing selective protection of the installation.

FIG. 8 illustrates the principle of this selectivity for a three level electric installation, namely:

a first level comprising a contact maker-breaker A, a second level comprising n contact makers-breakers $B_1, B_2, B_3, \ldots, B_n$ whose inputs are connected to the output of the contact maker-breaker A, and a third level comprising n contact makers-breakers $C_1, C_2, C_3 \ldots C_n$, whose respective inputs are connected to the output of the contact maker-breaker $B_1$.

The contact maker-breaker A, placed at the head of the installation, has a preset value for the current causing disengagement greater than that of the preset value of the current causing disengagement of contact makers-breakers $B_1, B_2, B_3 \ldots B_n$, this value being itself higher than the value of the current causing disengagement of the contact makers-breakers $C_1, C_2, C_3 \ldots C_n$ situated downstream.

Thus if a short circuit occurs downstream of contact makers - breakers $C_1, C_2, C_3 \ldots C_n$, it is one of these contact makers-breakers which will be disengaged first.

It should be noted that, when the possible short circuit values are very much higher than the preset disengagement values, voluntary delays may be provided for tripping the supply winding. Thus, if the current of a short circuit occuring downstream of a contact maker-breaker $C_1, C_2, C_3 \ldots C_n$ is very much greater than the setting of the contact maker-breaker B, the corresponding contact maker-breaker C will open before the contact maker-breaker B, which will also open while assisting the break. On the other hand, opening of the switching assembly of the contact maker-breaker C will occur before that of the switching assembly of the contact maker-breaker B because opening of this latter is delayed voluntarily. Once the break ensured, contactor B closes again and only the contact maker-breaker C effected is broken.

What is claimed is:

1. A contact equipped with a magnetic compensator with automatic self-disconnection from a compensating force threshold, this contact comprising at least two fixed contacts and a mobile contact bridge actuated by a switching assembly and having at least two mobile contacts which are applied respectively, under the effect of a spring, to the two fixed contacts in the closed position of the contactor, the connection between the mobile contact bridge and the switching assembly being provided by means of a magnetic compensator generating a compensation force tending to apply the mobile contacts on the fixed contacts under the effect of a current passing through the mobile contact bridge and this against the action of the repellent forces which are then exerted between these contacts, wherein the connection between the magnetic compensator and the switching assembly is provided by a magnetic coupling device adapted so that when said compensating forces rise above a predetermined threshold, the magnetic compensator is disengaged from the switching assembly and becomes inoperative and consequently a very sudden variation of the resultant repellent force exerted at the level of the contacts is obtained with very rapid opening of the contactor to the frankly open position.

2. The contact as claimed in claim 1, in which said magnetic compensator comprises at least a first magnetic piece integral with the switching assembly and a second soft magnetic piece carried by the mobile contact bridge and forming with said first piece an air gap at the level of which are exerted the compensating forces generated by the passage of the current through said mobile contact bridge, wherein the connection between said first soft magnetic material piece and said switching assembly is provided by a magnetic coupling adapted so that, when said compensating forces rise above a given threshold, said first piece is disengaged from the switching assembly.

3. The contact as claimed in one of claim 1, in which said magnetic compensator comprises a first piece made from a soft magnetic material having the shape of a U whose base is coupled to the switching assembly of the contact and a second magnetic piece integral with said contact-carrying mobile bridge, adapted so as to form a first air gap with the upper ends of the legs of a U of the first piece, said contact-carrying mobile bridge being engaged in the opening of the U of the first piece so as to form a second air gap, wherein said first soft magnetic material piece is connected to the switching assembly and is formed by a magnetic coupling adapted so that, when said compensating forces rise above a given threshold, said first U shaped piece attracted towards the second piece is disengaged from the switching assembly.

4. The contact as claimed in of claim 2, wherein said second piece made from a soft magnetic material comprises a first abutment surface and said first piece made from a soft magnetic material comprises a second abutment surface adapted for striking said first abutment surface when said first piece is disengaged from said switching assembly following a rise of the compensating forces above said predetermined threshold.

5. The contact as claimed in claim 1, wherein said magnetic coupling comprises a magnetic anchorage circuit formed from two parts mobile with respect to each other, namely a first part integral with said first soft magnetic material piece of the compensator and a second part integral with said assembly.

6. The contact as claimed in claim 5, wherein said first part of the magnetic anchorage circuit comprises a soft magnetic material plate and said second part consists of a permanent magnet or an electromagnet.

7. The contact as claimed in of claim 5, wherein said soft magnetic material plate is connected to said first plate integral with said first soft magnetic material piece of the compensator by means of a rod adjustable in length.

8. The contact as claimed in claim 7, wherein the connection between said rod and said soft magnetic material plate is a ball-jointed connection.

9. The contact as claimed in one of claim 5, wherein a spring is inserted between the two said parts of the magnetic anchorage circuit.

10. The contact as claimed in claim 2, further comprising means for adjusting the position of said first soft magnetic piece of the compensator with respect to the position of said mobile contact bridge.

11. The contact as claimed in claim 1, further comprising means for delaying the return of the compensator to the reset state.

12. The contact as claimed in claim 1, wherein said plate is mobile inside a pocket formed in said mobile assembly and said delay means consist of a membrane through which said rod passes and which plays the role of a one-way air damper slowing down the return of the contactor to the reset position.

13. The contact as claimed in claim 1, further comprising a device for locking the magnetic compensator in the disengaged position, said device comprising unlocking means contrallable manually or remotely.

14. A contact maker-breaker comprising at least one contact circuit of the type comprising, in accordance with one of the preceding claims, at least two fixed contacts and a mobile contact actuated by a switching assembly and having at least two mobile contacts which are applied respectively, under the effect of a spring, on the two fixed contacts in the closed position of the contactor, the switching assembly being fixedly mounted on the armature of an electromagnet and connected to the mobile contact point by means of a magnetic compensator, the connection between the magnetic compensator and the switching assembly being formed by a magnetic coupling, further comprising a quick-break contact for the power supply circuit of the coil of the electromagnet whose mobile part is connected to said first soft magnetic material piece of the magnetic compensator.

15. The contact maker-breaker, as claimed in claim 14, wherein said quick-break contact comprises at least two fixed contacts carried by the fixed part of said magnetic anchorage circuit and on which is applied the soft magnetic material plate which then plays the role of mobile contact-carrier.

* * * * *

UNITED STATES PATENT AND TRADEMARK OFFICE

CERTIFICATE OF CORRECTION

PATENT NO. : 4,593,260

DATED : June 3, 1986

INVENTOR(S) : Jean P. Guery et al.

It is certified that error appears in the above-identified patent and that said Letters Patent are hereby corrected as shown below:

(75) Inventors: Jean P. Guery, Bezons;
Guy H. Lacan, Maisons Laffitte,
both of France

Signed and Sealed this

Twenty-eighth Day of October, 1986

[SEAL]

*Attest:*

DONALD J. QUIGG

*Attesting Officer* *Commissioner of Patents and Trademarks*